US007353740B1

(12) United States Patent
Hoffman

(10) Patent No.: US 7,353,740 B1
(45) Date of Patent: Apr. 8, 2008

(54) RAPID ADJUST MUZZLE SYSTEM

(75) Inventor: Brian R. Hoffman, Budd Lake, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 227 days.

(21) Appl. No.: 11/164,219

(22) Filed: Nov. 15, 2005

Related U.S. Application Data

(60) Provisional application No. 60/522,971, filed on Nov. 29, 2004.

(51) Int. Cl.
*F41C 27/18* (2006.01)
*F41A 21/32* (2006.01)

(52) U.S. Cl. ..... 89/14.05; 42/86; 42/107

(58) Field of Classification Search ..... 89/14.2–14.5, 89/14.05, 198; 42/1.06, 107, 86, 96, 105; 403/1, 42; 192/69.61, 69.62, 69.6, 89.2, 192/200
See application file for complete search history.

(56) References Cited

U.S. PATENT DOCUMENTS

| | | | | | |
|---|---|---|---|---|---|
| RE9,725 | E | * | 5/1881 | Fish | 192/69.62 |
| 2,124,075 | A | * | 7/1938 | Moore | 89/14.1 |
| 2,191,484 | A | * | 2/1940 | Hughes | 89/14.3 |
| 2,698,546 | A | * | 1/1955 | Bolsey et al. | 74/625 |
| 2,807,112 | A | * | 9/1957 | Garand | 42/105 |
| 2,859,444 | A | * | 11/1958 | Reymond | 227/8 |
| 2,953,972 | A | * | 9/1960 | Sorensen | 89/14.3 |
| 2,966,974 | A | * | 1/1961 | Paskowski et al. | 192/69.61 |
| 3,302,522 | A | * | 2/1967 | Laureys | 89/1.807 |
| 3,677,132 | A | * | 7/1972 | Plenge | 89/14.2 |
| 3,766,822 | A | * | 10/1973 | Sophinos | 89/14.5 |
| 3,971,285 | A | * | 7/1976 | Ellis et al. | 89/14.3 |
| 4,030,582 | A | * | 6/1977 | Brown et al. | 192/69.62 |
| 4,512,613 | A | * | 4/1985 | Nassiri | 301/1 |
| 4,893,426 | A | * | 1/1990 | Bixler | 42/75.01 |
| 5,433,133 | A | * | 7/1995 | La France | 89/14.2 |
| 5,559,302 | A | * | 9/1996 | Latka | 89/14.05 |
| 5,685,102 | A | * | 11/1997 | Latka | 42/85 |
| 5,698,810 | A | * | 12/1997 | Rose | 89/14.3 |
| 6,026,728 | A | * | 2/2000 | Guhring et al. | 89/14.5 |
| 6,973,863 | B1 | * | 12/2005 | Jones | 89/14.2 |
| 2003/0019351 | A1 | * | 1/2003 | Fluhr | 89/14.4 |

* cited by examiner

*Primary Examiner*—Bret Hayes
(74) *Attorney, Agent, or Firm*—John F. Moran

(57) ABSTRACT

A gun barrel adaptor includes a body having a central bore therethrough and including a flange, the flange having a hole therethrough, the body having a lower side on one side of the flange and an upper side on another side of the flange; a flat spring attached to a lower side of the flange; a stop disposed in the hole in the flange and extending above an upper side of the flange, the flat spring being operable to resist movement of the stop towards the lower side of the body; and at least one locking tab disposed on the upper side of the body. The gun barrel adaptor provides for quick change modularity of muzzle devices without the use of any special tools.

13 Claims, 5 Drawing Sheets

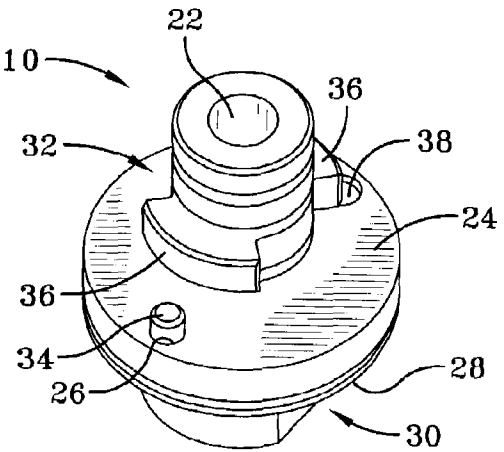
FIG-1A
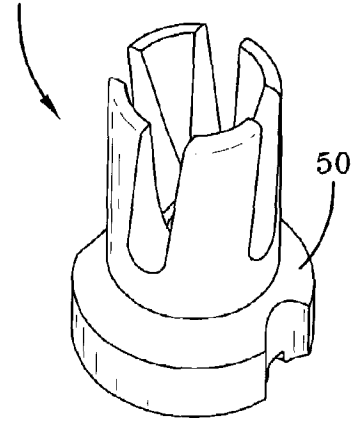
FIG-1B
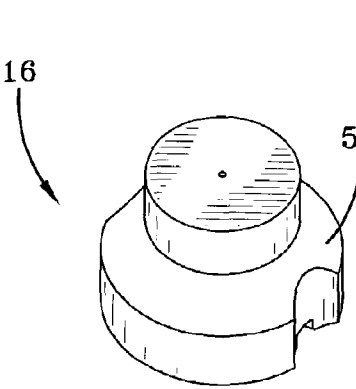
FIG-1C
FIG-1D
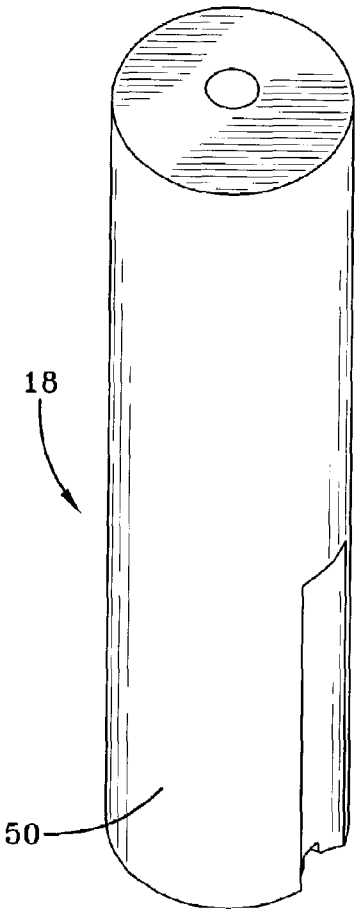
FIG-1E

RAPID ADJUST MUZZLE SYSTEM

CROSS-REFERENCE TO RELATED APPLICATIONS

This application claims the benefit under 35 USC 119(e) of U.S. provisional patent application 60/522,971 filed on Nov. 29, 2004, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to firearms and in particular to apparatus that attach to the muzzle end of firearms.

Excluding handguns, most small arms used in the U.S. military have a flash suppressor or muzzle compensator affixed to the end of the barrel. The particular muzzle device is installed during barrel production and generally not removed over the service life of the barrel. Additional training or combat accessories such as a blank firing attachment (BFA) or sound suppressor are then attached to the flash suppressor. Standard flash suppressor configurations include closed-end or open-end. While open-end flash suppressors are more effective at reducing the flash signature, closed-end flash suppressors are preferred in densely vegetated combat environments to prevent unwanted snagging of plant life.

Because the known flash suppressors are not meant to be removed, soldiers are restricted to a single configuration regardless of the fighting environment. This results in an unavoidable compromise in performance. Providing an alternate barrel with each flash suppressor configuration is an expensive and unsatisfactory solution. Changing the flash suppressor from the fielded configuration is not feasible either as this function cannot be easily accomplished at the operator level and would cause an unacceptable supportability burden.

Another problem relates to blank firing attachments (BFA). A BFA facilitates automatic cycling when firing blank ammunition to mimic normal weapon operation. Many BFA designs utilize a threaded stem that is hand-tightened to a flash suppressor during installation. Thus, installation and removal of the BFA requires threading and unthreading the BFA from the flash suppressor, which is a time consuming process. This general design also tends to vibrate loose during firing, which requires periodic retightening by the user in order to maintain consistent performance. Yet another problem with some firearms is the lack of a secure mounting platform that offers quick installation and removal of a sound suppressor without the use of special tools.

SUMMARY OF THE INVENTION

It is an object of the invention to provide an apparatus for changing muzzle-mounted devices quickly and without the use of any special tools.

Another object of the invention is to provide an apparatus for switching between open-end and closed-end flash suppressors without switching barrels or firearms.

A further object of the invention is to provide a BFA for gas-operated weapons that is faster to install and uninstall than known BFA designs.

Yet another object of the invention is to provide a BFA for gas-operated weapons that will not loosen during firing.

Still another object of the invention is to provide a secure platform for any muzzle-mounted device that may benefit from quick change modularity that can be accomplished without the use of special tools. This includes, but is not limited to, sound suppressors, nonlethal devices, rebar/wire cutting tools, and devices used to set the fuse on air bursting/timed rounds.

One aspect of the invention is an apparatus comprising a body having a central bore therethrough and including a flange, the flange having a hole therethrough, the body having a lower side on one side of the flange and an upper side on another side of the flange; a flat spring attached to a lower side of the flange; a stop disposed in the hole in the flange and extending above an upper side of the flange, the flat spring being operable to resist movement of the stop towards the lower side of the body; and at least one locking tab disposed on the upper side of the body. The apparatus may further comprise a gun barrel wherein the end of the body on the lower side is attached to the gun barrel.

In another aspect of the invention, a muzzle device having a base portion is connected to the apparatus. The base portion of the muzzle device comprises a first opening having a cross-section substantially the same as a cross-section through the at least one locking tab, a second generally circular opening having a radius substantially the same as a radial distance from a center of the central bore to a periphery of the at least one locking tab, and a third opening large enough to receive a portion of the upper side of the body above the at least one locking tab. The base portion further includes an opening in a bottom surface thereof for receiving the stop.

The muzzle device may comprise one of a blank firing attachment, a sound suppressor, a closed end flash suppressor and an open end flash suppressor.

In a further aspect of the invention, the muzzle device is a blank firing attachment comprising a plug formed in an upper end of the third opening of the base, the plug including a central opening therein.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 1A is a perspective view of a barrel adaptor.

FIG. 1B is a perspective view of an open end flash suppressor.

FIG. 1C is a perspective view of a closed end flash suppressor.

FIG. 1D is a perspective view of a blank firing attachment.

FIG. 1E is a perspective view of a sound suppressor.

DETAILED DESCRIPTION OF THE PREFERRED EMBODIMENTS

Figure 2:
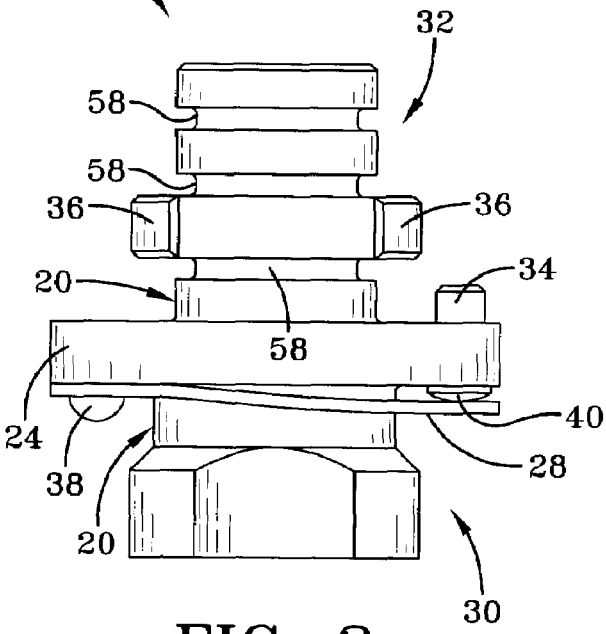
FIG. 2 is a front view of the barrel adaptor of FIG. 1A.

The present invention comprises a Rapid Adjust Muzzle System (RAMS). RAMS is an interchangeable system that allows the war fighter to exploit the capabilities of the most effective muzzle device that mission specific or environmental requirements will allow. The invention is applicable to rifles, small caliber machine guns, and medium caliber machine guns. The invention may be extended to handguns as well. A principal advantage of the invention is the ability to change muzzle devices quickly and without the use of any special tools, based on mission specific or environmental requirements.

The RAMS invention solves several problems. First, the invention solves the problem of deciding whether a closed-end or open-end flash suppressor configuration should be used on infantry rifles and light and medium caliber machine guns. With the RAMS system, soldiers deployed in an open environment such as Iraq can take advantage of the more effective open-end flash suppressor and quickly attach that muzzle device to the RAMS barrel adaptor. Soldiers deployed in a region with high amounts of ground vegetation can install a closed-end flash suppressor over the RAMS barrel adaptor to prevent the snagging problems associated with an open-end flash suppressor in such an environment.

Secondly, the RAMS BFA installed over the RAMS barrel adaptor effectively cycles and consistently powers a gas-operated weapon when firing blank ammunition without periodic attention to its operation by the user. Unlike conventional BFA designs, the RAMS BFA can be installed and removed very quickly and will not vibrate loose during firing.

Lastly, the RAMS barrel adaptor provides a secure mounting platform offering quick and easy installation and removal of any muzzle-mounted device without the use of special tools. RAMS offers the advantages of modularity and the potential of muzzle device commonality, particularly among weapons of similar caliber. Any desired muzzle-mounted device may benefit from the RAMS invention. As an example, the RAMS sound suppressor utilizes the interface of the RAMS barrel adaptor for noise suppression capability.

The RAMS barrel adaptor can be retrofitted to existing barrels or incorporated directly into the manufacture of future barrels. The barrel adaptor remains attached to the barrel at all times. Any muzzle device that utilizes the RAMS interface principle can be quickly installed without the use of any special tools. A simple quarter-turn will lock the muzzle device in place to prevent rotation. Locking is accomplished through the use of a stop that fits into a detent or stop opening in the muzzle device. The stop remains secure in the detent due to the pressure applied by a circular flat spring, which is permanently assembled to the barrel adaptor. Removal of the muzzle device is also simple. First, the stop is depressed using, for example, a bullet tip or the base of any cartridge case, and then the muzzle device is rotated a quarter-turn.

RAMS components may be made of steel common to the production of current flash suppressors. Components may also be made of lighter weight metallic alloys with sufficient surface coatings to combat the erosive effects of combustion gases and unburned propellant. RAMS components may be machined, or cast and finished machined. Heat treatment and surface coatings similar to those used with current flash suppressors may be applied.

FIG. 1A is a perspective view of one embodiment of a barrel adaptor 10. The barrel adaptor 10 is connected to the muzzle end of a gun barrel. The barrel adaptor 10 may be manufactured integral with the gun barrel or may be attached to an existing gun barrel by a variety of methods. The barrel adaptor 10 provides an easy to use attachment interface for muzzle devices and is not intended to be removed from the gun barrel.

FIGS. 1B-1E show examples of muzzle devices that may be used with the barrel adaptor 10. Each of the muzzle devices has a base 50 that is easily connected to and disconnected from the barrel adaptor 10. FIG. 1B is a perspective view of an open end flash suppressor 12. FIG. 1C is a perspective view of a closed end flash suppressor 14. FIG. 1D is a perspective view of a BFA 16. FIG. 1E is a perspective view of a sound suppressor 18.

Figure 3A:
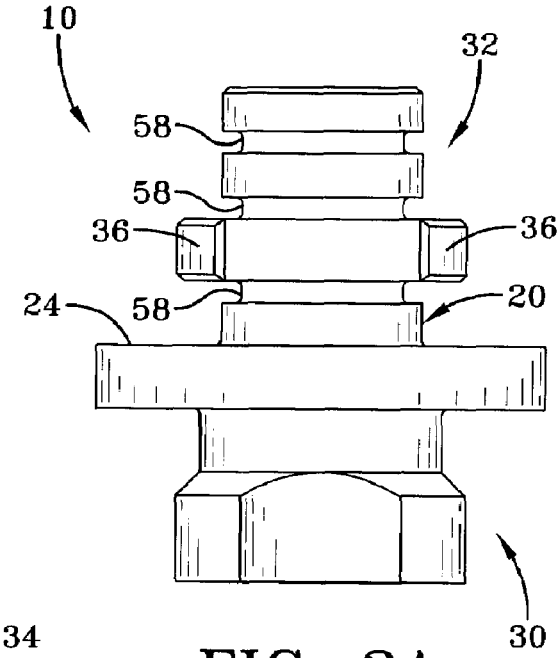
FIG. 3A is a front view of the body of the barrel adaptor of FIG. 2.
Figure 3B:
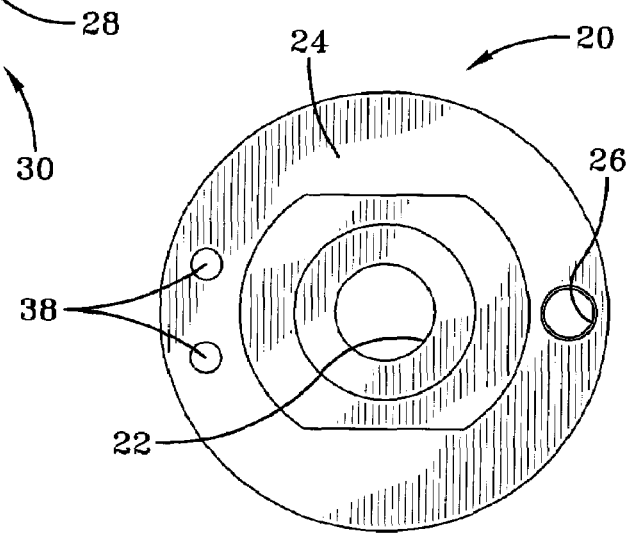
FIG. 3B is a bottom view of FIG. 3A.
Figure 3C:
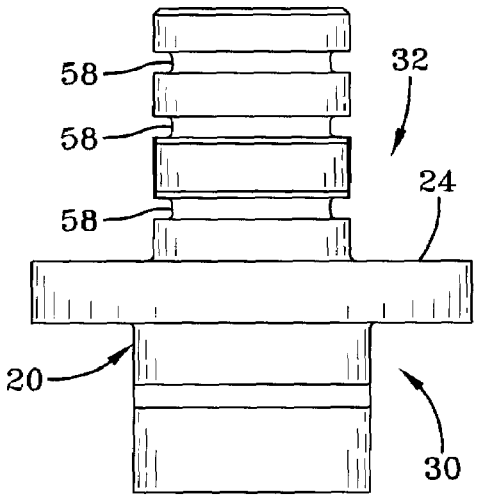
FIG. 3C is a side view of FIG. 3A.
Figure 3D:
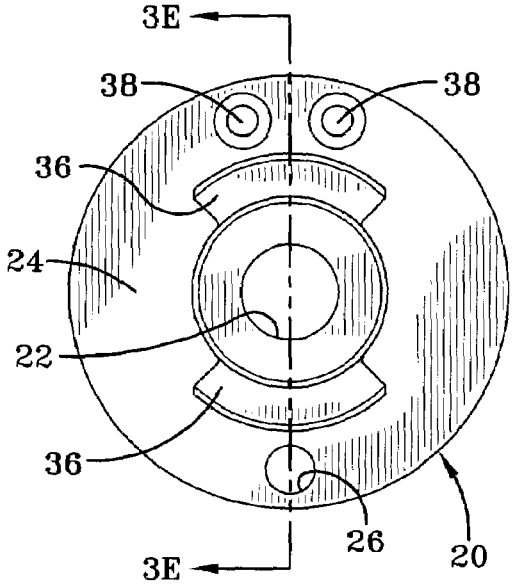
FIG. 3D is a top view of FIG. 3C.
Figure 3E:
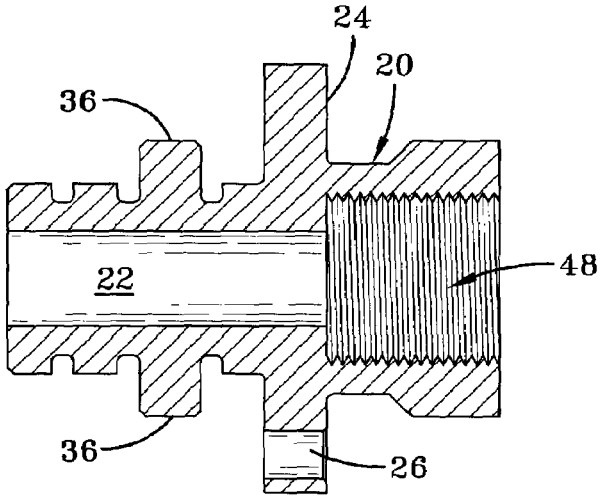
FIG. 3E is a sectional view along the line 3E-3E of FIG. 3D.

FIG. 2 is a front view of the barrel adaptor 10 of FIG. 1A. FIG. 3A is a front view of the body 20 of the barrel adaptor of FIG. 2. FIG. 3B is a bottom view of FIG. 3A. FIG. 3C is a side view of FIG. 3A. FIG. 3D is a top view of FIG. 3C. FIG. 3E is a sectional view along the line 3E-3E of FIG. 3D. Referring to FIGS. 1A, 2 and 3A-3E, the barrel adaptor 10 comprises a body 20 having a central bore 22 therethrough and including a flange 24. The flange 24 has a hole 26 therethrough. The body 20 has a lower side 30 on one side of the flange 24 and an upper side 32 on another side of the flange 24.

Figure 4A:
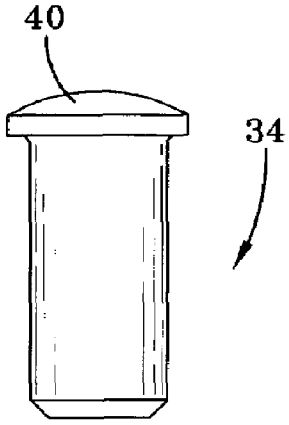
FIG. 4A is a front view of a stop.
Figure 4B:
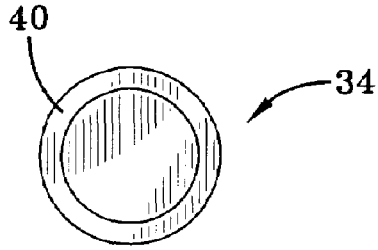
FIG. 4B is a bottom view of FIG. 4A.
Figure 5A:
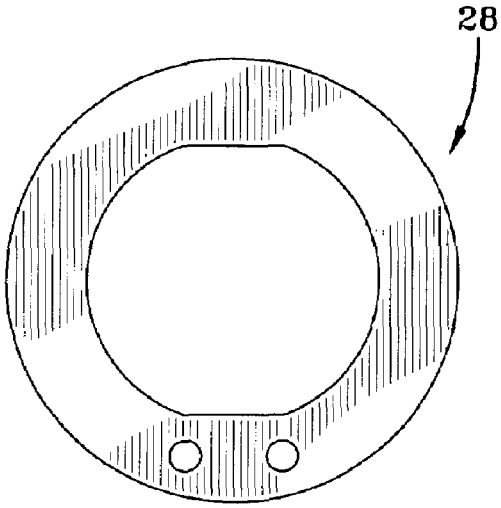
FIG. 5A is a front view of a flat spring.
Figure 5B:
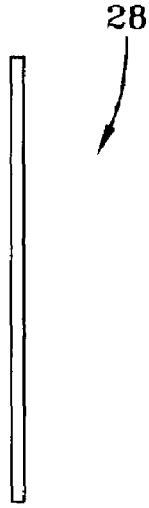
FIG. 5B is a side view of FIG. 5A.

A flat spring 28 (FIGS. 5A and 5B) is attached to a lower side of the flange 24. A stop 34 (FIGS. 4A and 4B) is disposed in the hole 26 in the flange 24. Stop 34 extends above an upper side of the flange 24. The flat spring 28 is operable to resist movement of the stop 34 towards the lower side 30 of the body 20. At least one locking tab 36 is disposed on the upper side 32 of the body 20. The number, size and shape of the locking tabs 36 may be varied. In a preferred embodiment, two locking tabs 36 are used.

The flat spring 28 is attached to the flange 24 with at least one fastener 38, such as a rivet. Preferably, two fasteners 38 are used. Fasteners 38 are preferably located about 180 degrees from the stop 34 to allow deflection of the flat spring 28 by the stop 34. Stop 34 includes a head 40 that limits motion of stop 34 in an upper direction.

The upper side 32 of the body 20 may optionally include at least one circumferential groove 58 (FIGS. 2, 3A, 3C) formed therein. In a preferred embodiment, there are two circumferential grooves 58 above the locking tab(s) 36 and one circumferential groove 58 below the locking tab 36. The function of the grooves 58 is to cause turbulence in any gas that may exit the upper end of the body 20 and blow back across the barrel adaptor 10. Inducing turbulence helps to mitigate the amount of gas that may blow back across the barrel adaptor 10.

Figure 6:
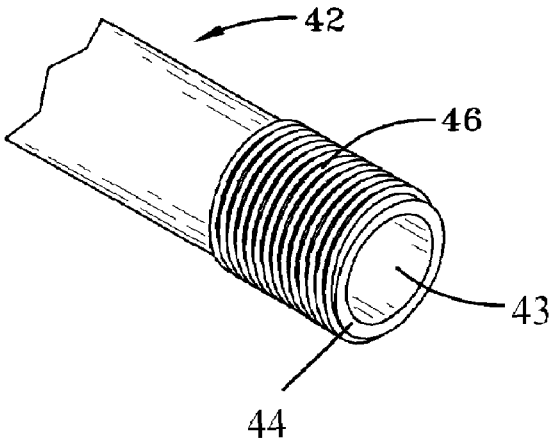
FIG. 6 is a side view of a portion of a gun barrel.

FIG. 6 shows part of a gun barrel 42 having a muzzle end 44. The lower side 30 of the barrel adaptor 10 is connected to the muzzle end 44 of the gun barrel 42. Gun barrel 42 has a bore 43 with an inner diameter. The central bore 22 of the body 20 has an inner diameter that is at least as large as the maximum inner diameter of the bore 43 of the gun barrel 42. For example, in the case of a smooth bore barrel, the inner diameter of the bore is constant. For example, in the case of rifled barrels comprising lands and grooves, the maximum inner diameter is the groove diameter. Barrel adaptor 10 may be integrally formed with the gun barrel 42 or it may be attached to an existing barrel in a variety of ways.

FIG. 6 shows external threads 46 at the muzzle end of the gun barrel. Many existing military firearms have externally threaded muzzles. For those firearms, the lower side 30 of the body 20 of barrel adaptor 10 includes a second bore 48 (FIG. 3E) that is larger in diameter than the central bore 22, for receiving an end of the gun barrel 42. The inside of second bore 48 may be threaded to receive the external threads 46 of the gun barrel. Or, if the muzzle is not externally threaded, the gun barrel 42 and the second bore 48 may be press fit together. Another option (not shown in the Figs.) for attaching the barrel adapter 10 to a gun barrel 42 is to provide a semicircular longitudinal slot in the exterior surface of the barrel, a through hole in a flange at the lower end of the barrel adapter and a pin that extends through the through hole into the slot in the barrel.

The invention further includes a muzzle device having a base portion that connects to the barrel adaptor 10. As discussed above, the muzzle device may be, for example, an open end flash suppressor 12, a closed end flash suppressor 14, a BFA 16 or a sound suppressor 18. Each of the open end flash suppressor 12, closed end flash suppressor 14, BFA 16, sound suppressor 18 or other muzzle device includes a base portion 50 that attaches to the barrel adaptor 10.

Figure 7C:
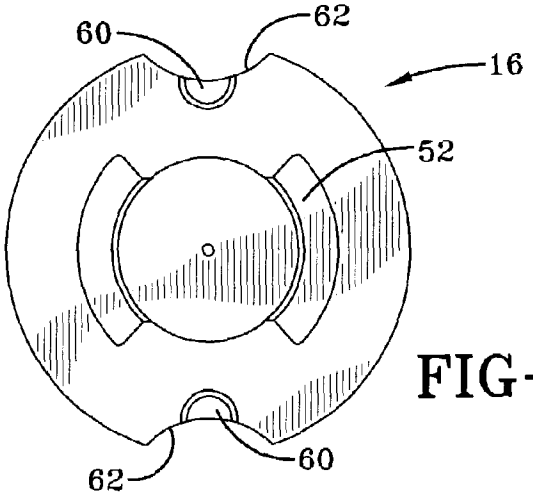
FIG. 7C is a bottom view of FIG. 7A.
Figure 7D:
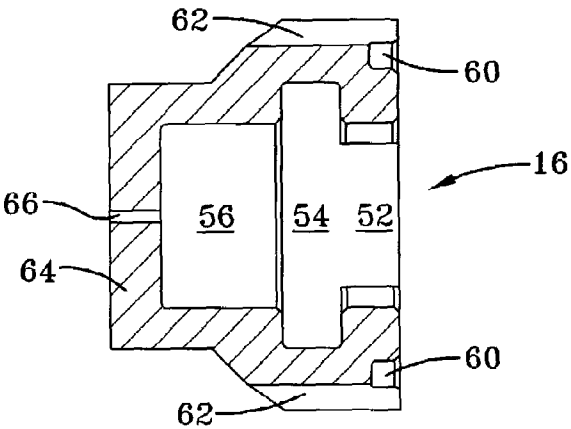
FIG. 7D is a sectional view taken along the line 7D-7D of FIG. 7B.
Figure 7B:
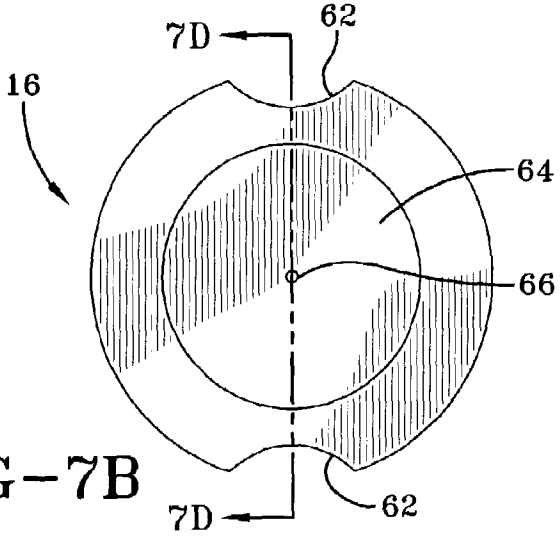
FIG. 7B is a top view of FIG. 7A.
Figure 7A:
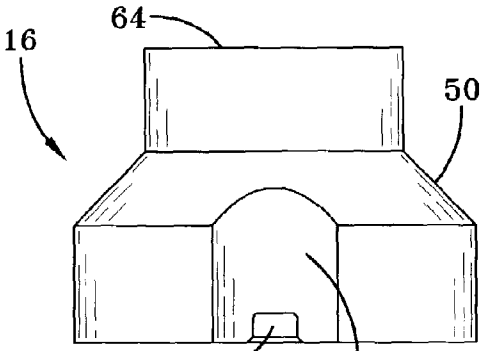
FIG. 7A is a front view of the BFA shown in FIG. 1D.

The base portion 50 will be described with reference to one of the muzzle devices, specifically, the BFA 16. The structure of the base portion 50 is the same for any of the other muzzle devices. FIG. 7A is a front view of one embodiment of BFA 16. FIG. 7B is a top view of FIG. 7A. FIG. 7C is a bottom view of FIG. 7A. FIG. 7D is a sectional view taken along the line 7D-7D of FIG. 7B.

The base portion 50 comprises a first opening 52 (best seen in FIG. 7C) having a cross-section substantially the same as a cross-section through the at least one locking tab 36, a second generally circular opening 54 (FIG. 7D) having a radius substantially the same as a radial distance from a center of the central bore 22 to a periphery of the at least one locking tab 36, and a third opening 56 (FIG. 7D) that is large enough to receive that portion of the upper side 32 of the body 20 that is above the at least one locking tab 36.

The base portion 50 includes an opening 60 in a bottom surface thereof for receiving the stop 34. In a preferred embodiment, as shown in FIGS. 7C and 7D, two openings 60 spaced 180 degrees apart are provided. With two openings 60, the muzzle device need only be rotated a quarter turn (ninety degrees) in either direction when attaching it or removing it from the barrel adaptor 10. An access groove 62 is formed adjacent the opening 60 in the bottom surface, for depressing the stop 34.

Using the barrel adaptor 10 with a muzzle device is simple. As discussed before, the barrel adaptor 10 is attached to a gun barrel 42 in any of a variety of ways. To install a muzzle device to the barrel adapter 10, the base 50 of the muzzle device is lowered onto the upper end of the adapter 10 until the bottom surface of the base 50 contacts the stop 34. Additional pressure is then applied to the muzzle device to force the stop 34 downward against the flat spring 28 until the base 50 of the muzzle device is substantially in contact with the upper surface of the flange 24. In this position, the locking tab(s) 36 are in the second opening 54 in the base 50, allowing the base 50 to rotate with respect to the adaptor 10. The muzzle device is then rotated a quarter turn (ninety degrees) thereby aligning the stop 34 with the stop opening 60 in the base 50. The force of the flat spring 28 against the stop 34 moves the stop 34 into the stop opening 60. The stop 34 remains secure in the stop opening 60 due to the pressure applied by flat spring 28, which is permanently assembled to the barrel adaptor 10. Thus, the muzzle device is locked to the barrel adaptor 10.

To remove the muzzle device from the barrel adaptor 10, the stop 34 is first depressed. The size and shape of the access groove 62 is such that the base of a conventional ammunition cartridge casing may be used to depress the stop 34. When the stop 34 is depressed approximately even with the upper surface of the flange 24, the base 50 is free to rotate with respect to the barrel adaptor 10. The base 50 and muzzle device are then rotated a quarter turn until the locking tab 36 is aligned with the first opening 52 in the base 50. The muzzle device may then be lifted off the barrel adaptor 10. If desired, another muzzle device may then be installed, as described above. The barrel adaptor 10 is designed to remain attached to the barrel 42 at all times. Any muzzle device that includes a base 50 can be quickly installed on the adaptor 10. A simple quarter-turn will lock the muzzle device in place to prevent rotation.

A further novel aspect of the invention is the BFA 16 shown in FIGS. 7A-7D. In addition to the novel base 50, the BFA 16 includes a plug 64 formed at the upper end of the third opening 56 of the base 50. The plug 64 including a central opening 66 therein. The central opening 66 functions as a bleed hole to relieve overpressure when firing blank ammunition. Blanks are fired during weapons training, for example. When blank ammunition is used in combination with the BFA 16, it is possible to automatically cycle a gas-operated weapon to mimic normal operation with combat ammunition.

The diameter of central opening 64 is specific to a particular weapon because different caliber cartridges create varying levels of pressure within the bore. Even among weapons of the same caliber, the pressure required to cycle a gas-operated weapon varies due to differences in physical characteristics such as the mass of the weapon's operating group. If a single weapon has multiple barrel lengths, the internal volume difference creates varying levels of pressure within the weapon, so the diameter of the central opening 66 may vary. Mathematically, the optimum diameter of central opening 66 can be predicted for a given weapon and particular barrel length, although in practice it is just as quick and easy to experimentally derive the optimized diameter by conducting a time-displacement analysis of the weapon's operating group and comparing the resultant data when firing blank ammunition to data produced when firing ball ammunition.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus, comprising:

a body having a central bore therethrough and including a flange, the flange having a hole therethrough, the body having a lower side on one side of the flange and an upper side on another side of the flange;

a flat spring attached to a lower side of the flange;

a stop disposed in the hole in the flange and extending above an upper side of the flange, the flat spring being operable to resist movement of the stop towards the lower side of the body;

at least one locking tab disposed on the upper side of the body; and a gun barrel, an end of the body on the lower side being attached to the gun barrel.

2. The apparatus of claim 1 wherein the flat spring is attached to the flange with at least one fastener.

3. The apparatus of claim 1 wherein the end of the body comprises a second bore larger in diameter than the central bore, for receiving an end of the gun barrel.

4. The apparatus of claim 3 wherein the second bore is internally threaded and the end of the gun barrel is externally threaded such that the second bore threads onto the gun barrel.

5. The apparatus of claim 1 wherein the upper side of the body includes at least one circumferential groove formed therein.

6. The apparatus of claim 1 wherein the central bore of the body has an inner diameter that is at least as large as a maximum inner diameter of the gun barrel.

7. The apparatus of claim 1 further comprising a muzzle device having a base portion that connects to the apparatus.

8. The apparatus of claim 7 wherein the base portion comprises a first opening having a cross-section substantially the same as a cross-section through the at least one locking tab, a second generally circular opening having a radius substantially the same as a radial distance from a center of the central bore to a periphery of the at least one locking tab, and a third opening large enough to receive a portion of the upper side of the body above the at least one locking tab.

9. The apparatus of claim 8 wherein the at least one locking tab comprises two locking tabs.

10. The apparatus of claim 8 wherein the base portion includes an opening in a bottom surface thereof for receiving the stop.

11. The apparatus of claim 1 wherein an access groove is formed adjacent the opening in the bottom surface, for depressing the stop.

12. The apparatus of claim 7 wherein the muzzle device comprises one of a blank firing attachment, a sound suppressor, a closed end flash suppressor and an open end flash suppressor.

13. The apparatus of claim 8 wherein the muzzle device is a blank firing attachment comprising a plug formed in an upper end of the third opening of the base, the plug including a central opening therein.

* * * * *